United States Patent [19]

Machin

[11] Patent Number: 4,836,264

[45] Date of Patent: Jun. 6, 1989

[54] ROLLER BLIND ASSEMBLY

[75] Inventor: Francis Machin, London, United Kingdom

[73] Assignee: Machin Designs Limited, United Kingdom

[21] Appl. No.: 128,810

[22] Filed: May 27, 1987

[30] Foreign Application Priority Data

May 27, 1986 [GB] United Kingdom ..... 8612854

[51] Int. Cl.[4] ..... E06B 9/08

[52] U.S. Cl. ..... 160/120; 160/66; 160/265

[58] Field of Search ..... 160/265, 274, 243, 120, 160/285, 241, 66

[56] References Cited

U.S. PATENT DOCUMENTS

| | | | |
|---|---|---|---|
| 1,556,915 | 10/1925 | Cooley | 160/274 X |
| 3,306,345 | 2/1967 | Youngs | 160/243 |
| 3,878,879 | 4/1975 | Manns | 160/273 |
| 4,433,712 | 2/1984 | Mellon et al. | 160/122 |

FOREIGN PATENT DOCUMENTS

| | | |
|---|---|---|
| 698334 | 11/1940 | Fed. Rep. of Germany . |
| 2050641 | 1/1981 | United Kingdom . |
| 2099055 | 12/1982 | United Kingdom . |

*Primary Examiner*—Blair M. Johnson

*Attorney, Agent, or Firm*—Roylance, Abrams, Berdo & Goodman

[57] ABSTRACT

A roller blind assembly in which the blind roller (10, 12, 14) is turnable, preferably by a motor, to raise and lower the blind along a track (28). To reduce friction and prevent jamming due to dirt or debris on the track, the lower end of the blind is linked (32) to an inertia device (30) preferably in the form of a tubular roller having a relatively high amount of inertia and mounted for rotation with guide wheels (34) at each end of the roller running in parallel tracks 28). The angular momentum developed by the roller (30) assists in drawing the blind over obstructions in the track (28) and is additional to any gravitational effects.

7 Claims, 3 Drawing Sheets

ROLLER BLIND ASSEMBLY

This invention relates to a roller blind assembly, more particularly, though not exclusively a roof blind assembly suitable for use with skylights or in conservatories or other glazed structures.

Conventional roof blinds for conservatories have an upper roller around which the blind is wound and which is turnable perhaps by a hand cranked mechanism but more commonly by a motor, enabling the blind to be raised and lowered by remote control. The lower end of the blind which is usually weighted to keep the blind taut, is guided by wheels or rollers running in the tracks following the downwardly sloping contours of the roof.

When the pitch of the roof is shallow, the weight of the lower end of the blind may be insufficient to overcome the friction arising between the fabric of the blind and the track, with the result that the blind sticks. Also, by virtue of being disposed in the roof, these tracks are difficult to clean and maintain with the result that after a time, accumulated dirt or debris creates an obstruction causing the wheels to jam so preventing lowering of the blind.

One object of the present invention is to at least mitigate this problem.

According to the present invention we propose a roller blind assembly having a roller around which the blind is wound and which is turnable in opposite directions respectively to raise and lower the blind along a track, the blind being linked to an inertia device rotatable as the blind is lowered by means running on the track. The angular momentum developed by the inertia device as the blind is lowered, serves to overcome the frictional resistance caused by the blind fabric on the track and draw the blind over obstructions in the track, this being additional to any gravitational effects either on the inertia roller or on the weighted lower edge of the blind.

Where, as with conventional roof blinds, the lower end of the blind is fitted with wheels which run in parallel tracks, one or each of the wheels may be connected an inertial mass functioning similar to as a flywheel, which once in motion develops sufficient momentum to traverse obstructions.

In a preferred embodiment, however, a separate inertia roller is used, this having guide wheels running in the tracks and comprising a relatively large diameter and heavy cylinder mounted between the wheels for rotation therewith.

An embodiment of the present invention will now be described by way of example with reference to the accompanying drawings, in which.

Figure 1:
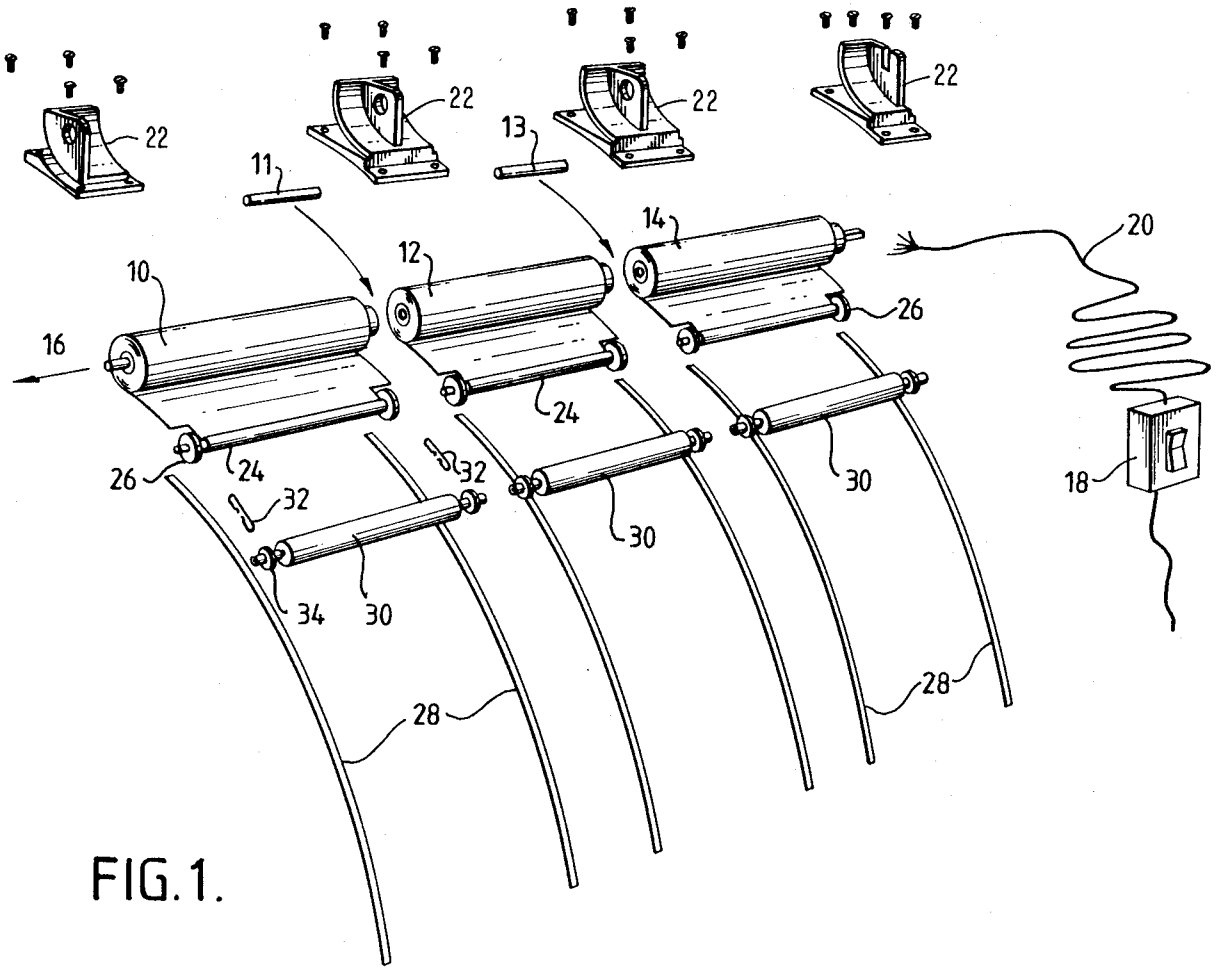
FIG. 1 is a schematic exploded view of a multiple roller blind assembly for the roof of a conservatory.
Figure 3:
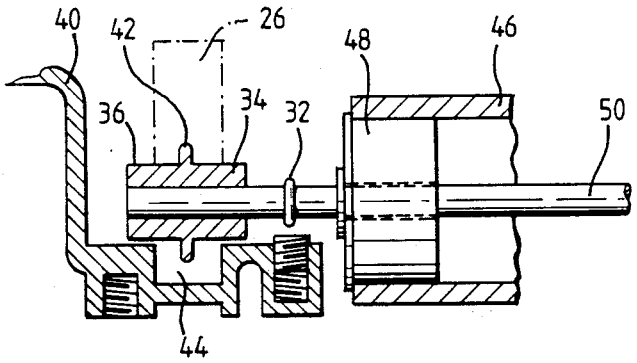
FIG. 3 is a longitudinal cross-sectional view on 3—3 in FIG. 2.

The multiple roller blind assembly shown in FIG. 1 is intended for use in the roof of a conservatory, details of which are not shown, and is installed under the ridge of the roof so that, in use, each blind is lowered beneath the glazed panels along parallel tracks provided in extruded aluminium sections forming glazing bars of the roof (see FIG. 3). Three roller blinds 10, 12 14 are shown in FIG. 1 corresponding to three bays in the roof and connected together end to end by shafts 11 and 13 on a common axis 16 driven by a motor (not shown) fitted within the right-hand end and roller blind 14, referred to as the motor blind, which is operable remotely by a wall switch 16 to which it is connected by a cable 20. The blinds are rotatably supported by four brackets 22 secured to the roof structures.

At the lower end of each blind is a rod or spindle 24 passing through a sewn loop in the blind material. Rotatably mounted on the ends of the rod are wheels 26 which run along the parallel tracks 28 following the downwardly sloping contours of the roof.

Figure 2:
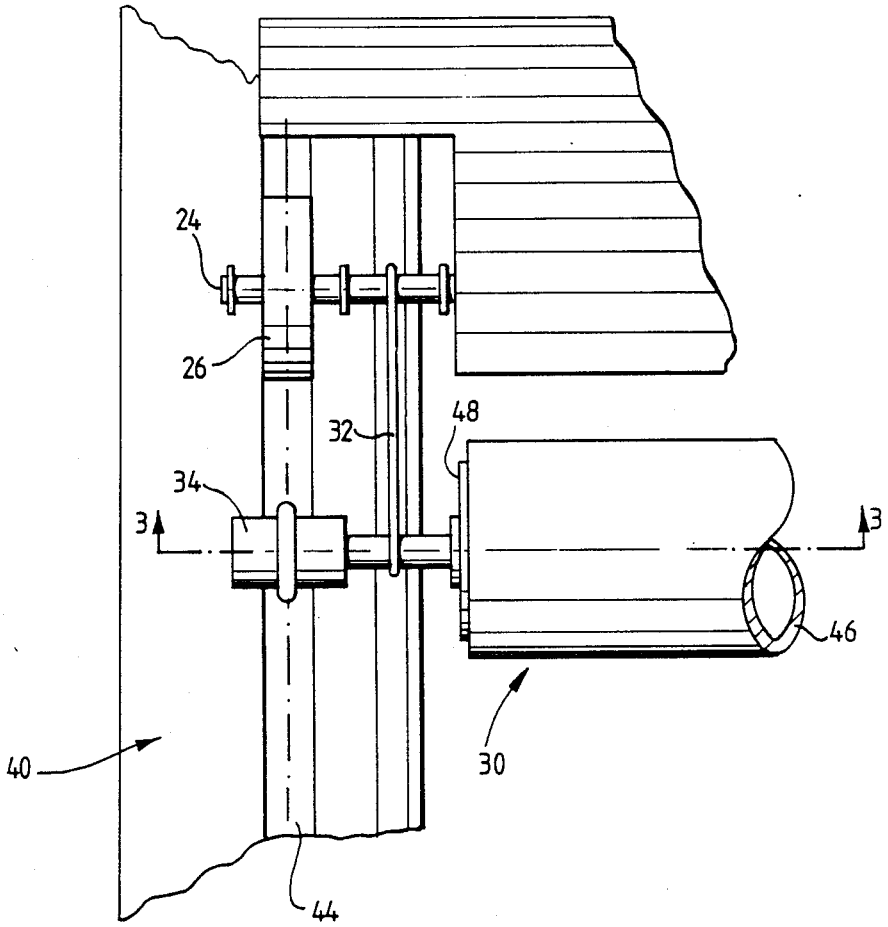
FIG. 2 is a fragmentary view showing an inertia roller linked to the lower end of the roller blind.
Figure 4:
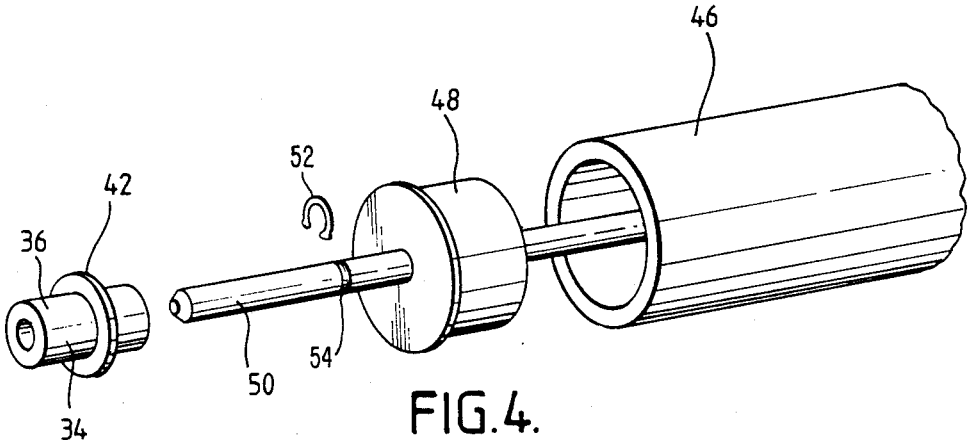
FIG. 4 is an exploded view of the inertia roller.

As will be seen more clearly in FIG. 2, an inertia roller 30 is suspended parallel with the rod 24 by links 32 at each end thereof. The inertia roller 30, is supported on the glazing bars as shown in FIGS. 3 and 4 and has at each end a guide wheel 34 the external cylindrical surface 36 of which runs on the glazing bar 40 guided by a peripheral projection 42 in the middle of the wheel 34 which is received by a recess 44 forming the track for the blind wheel (shown dotted).

In order to make the moment of inertia of the inertia roller 30 as high as possible consistent with the space available and without unduly increasing its weight, the inertia roller is formed of a thick walled metal tube 46 shown in FIG. 3, in the ends of which bosses 48 are press-fitted. The guide wheels 34 are secured to the ends of a spindle 50 passing through the holes in the bosses 48 and by which the metal tube 46 is rotatable.

Figure 5:
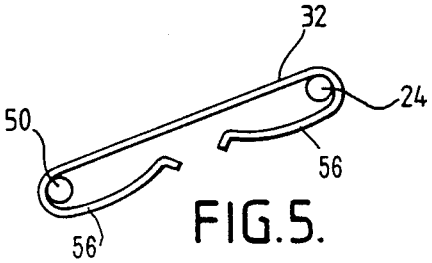
FIG. 5 shows to an enlarged scale a clip for linking the inertia roller to the blind.

A plastics runner 52 is fitted in a recess 54 parallel to the blind wheel recess 44, to reduce friction arising due to the link 32 rubbing against the glazing bar. As will be seen from FIG. 5, the internal diameter of the clips 56 at each end of the link 32 is made larger than the diameter of the spindles 24 and 50 in engagement therewith. This also serves to reduce the friction.

In operation, when the motor blind 14 is actuated all three roller blinds 10, 12 and 14 turn so that the blind begins to lower along the tracks 28. The inertia roller suspended from the lower end of the blind thus rotates as it descends and develops sufficient momentum to overcome the frictional resistance caused by rubbing of the blind material on the tracks 28 and to draw the blind wheels over any debris and dirt that may have collected in the recesses 44. It will be understood that the greater the difference in diameter between the wheels 34 and the metal tube, the greater the angular momentum of the inertia roller.

I claim:

1. A roller blind assembly, comprising:

a roller;

a blind having one end coupled to said roller and a leading end;

said blind being wound around said roller and said roller being turnable in opposite directions respectively to raise and lower a leading end of said blind along at least two parallel tracks; and an inertia device linked to said blind and rotatable as said blind is lowered, said inertia device including an inertia roller linked to said leading end of said blind and being spaced therefrom, said inertia roller having guide wheels, said inertia roller being mounted for rotation with said guide wheels running on said tracks.

2. A roller blind assembly according to claim 1 wherein said inertia roller is mounted between said guide wheels.

3. A roller blind assembly according to claim 2 wherein a blind spindle is attached to said leading end of said blind, each end of said blind spindle having a spindle wheel running in a recess extending along each of said tracks, each of said guide wheels bridging the respective recess and having an annular projection received in the recess and guiding said inertia roller along each of said tracks.

4. A roller blind assembly according to claim 2 wherein said inertia roller comprises a thick-walled tube having a boss fitted in each end thereof with an inertia roller spindle passing through each said boss and being secured to said guide wheels.

5. A roller blind assembly according to claim 3 wherein said inertia roller comprises a thick-walled tube having a boss fitted in each end thereof with an inertia roller spindle passing through each said boss and being secured to said guide wheels.

6. A roller blind assembly according to claim 5 wherein said inertia roller is suspended from and parallel with said blind spindle at the leading end of the blind by links, each said link having a clip at one end receiving the inertia roller spindle and a clip at the other end receiving the blind spindle.

7. A roller blind assembly according to claim 1 wherein two or more roller blinds are mounted and connected for turning together about a common axis to raise and lower the blinds.

* * * * *